US009883716B2

(12) United States Patent
Jones

(10) Patent No.: US 9,883,716 B2
(45) Date of Patent: Feb. 6, 2018

(54) FOOTWEAR SOLE

(71) Applicant: Berghaus Limited, London (GB)

(72) Inventor: Martin Jones, London (GB)

(73) Assignee: BERGHAUS LIMITED, London (GB)

( * ) Notice: Subject to any disclaimer, the term of this patent is extended or adjusted under 35 U.S.C. 154(b) by 147 days.

(21) Appl. No.: 14/286,629

(22) Filed: May 23, 2014

(65) Prior Publication Data

US 2014/0338229 A1 Nov. 20, 2014

Related U.S. Application Data

(63) Continuation of application No. 13/623,628, filed on Sep. 20, 2012, now abandoned, which is a continuation of application No. 11/750,015, filed on May 17, 2007, now abandoned.

(30) Foreign Application Priority Data

May 17, 2006 (GB) ..... 0609808.1

(51) Int. Cl.

| | |
|---|---|
| ***A43B 13/26*** | (2006.01) |
| ***A43C 15/02*** | (2006.01) |
| ***A43C 15/16*** | (2006.01) |
| ***A43B 5/00*** | (2006.01) |

(52) U.S. Cl.

CPC ..... *A43B 13/26* (2013.01); *A43B 5/00* (2013.01); *A43C 15/02* (2013.01); *A43C 15/162* (2013.01)

(58) Field of Classification Search

CPC ..... A43B 3/0068; A43B 5/02; A43B 13/26; A43C 15/02; A43C 15/16; A43C 15/162

USPC ..... 36/67 A, 67 R, 124, 134; D2/906, 962

See application file for complete search history.

(56) References Cited

U.S. PATENT DOCUMENTS

| | | | | |
|---|---|---|---|---|
| 3,063,171 A | | 11/1962 | Hollander | |
| 3,352,034 A | | 11/1967 | Braun | |
| 3,513,571 A | | 5/1970 | Larcher | |
| 3,656,245 A | | 4/1972 | Wilson | |
| 4,180,923 A | | 1/1980 | Dassler | |
| 4,392,312 A | * | 7/1983 | Crowley | A43B 13/26 36/126 |

(Continued)

FOREIGN PATENT DOCUMENTS

| | | |
|---|---|---|
| DE | 1 073 907 | 1/1960 |
| DE | 25 46 971 | 4/1977 |

(Continued)

OTHER PUBLICATIONS

European Examination Report, Application No. 07 252 009 1-1658, dated Mar. 26, 2014.

*Primary Examiner* — Sharon M Prange
(74) *Attorney, Agent, or Firm* — Marvin Petry; Stites & Harbison, PLLC

(57) ABSTRACT

A shoe sole having a bottom surface with a plurality of stud clusters extending therefrom is provided, each stud cluster comprising at least two studs connected via one or more connection elements, wherein, to optimise the manner in which the stud clusters deal with forces applied to them during ground contact, each stud cluster is oriented in accordance with a predetermined direction of gross shear motion of the stud cluster and each stud cluster is dimensioned in accordance with the distribution of forces applied to the sole during ground contact.

11 Claims, 10 Drawing Sheets

(56) References Cited

U.S. PATENT DOCUMENTS

Figure 1A:
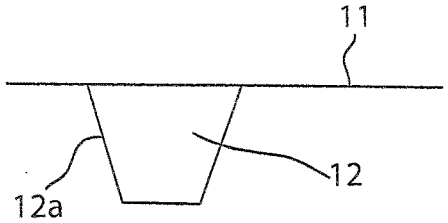
Fig. 1a (prior art)

| | | | | |
|---|---|---|---|---|
| 4,393,604 | A * | 7/1983 | Crowley | A43C 15/162 36/126 |
| 4,689,901 | A | 9/1987 | Ihlenburg | |
| 4,742,626 | A | 5/1988 | Tadiotto | |
| 4,745,692 | A | 5/1988 | Liao | |
| 4,858,343 | A | 8/1989 | Flemming | |
| 5,201,126 | A | 4/1993 | Tanel | |
| 5,351,421 | A | 10/1994 | Miers | |
| 5,473,827 | A | 12/1995 | Barre et al. | |
| 5,617,653 | A | 4/1997 | Walker et al. | |
| 5,887,371 | A | 3/1999 | Curley, Jr. | |
| 5,926,974 | A | 7/1999 | Friton | |
| 5,943,794 | A | 8/1999 | Gelsomini | |
| 6,023,860 | A | 2/2000 | McMullin | |
| 6,101,746 | A | 8/2000 | Evans | |
| 6,182,381 | B1 * | 2/2001 | Kaneko | A43B 7/1425 36/126 |
| 6,341,433 | B1 | 1/2002 | Nakamura | |
| 6,357,146 | B1 | 3/2002 | Wordsworth et al. | |
| 6,675,505 | B2 | 1/2004 | Terashima | |
| 6,793,996 | B1 | 9/2004 | Umezawa | |
| 6,826,852 | B2 | 12/2004 | Fusco | |
| 6,892,479 | B2 * | 5/2005 | Auger | A43C 15/162 36/128 |
| 6,973,745 | B2 * | 12/2005 | Mills | A43B 3/0068 36/113 |
| 7,010,871 | B2 | 3/2006 | Sussmann | |
| 7,143,530 | B2 * | 12/2006 | Hudson | A43B 1/0072 36/128 |
| 2002/0100190 | A1 | 8/2002 | Pellerin | |
| 2003/0188458 | A1 | 10/2003 | Kelly | |
| 2004/0040181 | A1 | 3/2004 | Kim | |
| 2004/0250451 | A1 | 12/2004 | McMullin | |
| 2005/0120593 | A1 | 6/2005 | Mason | |

FOREIGN PATENT DOCUMENTS

| | | |
|---|---|---|
| EP | 0 261 557 | 3/1988 |
| EP | 0 342 232 | 11/1989 |
| EP | 0 451 379 | 10/1991 |
| EP | 0 524 861 | 1/1993 |
| EP | 0 783 845 | 7/1997 |
| EP | 1 234 516 | 8/2002 |
| FR | 1 038 034 | 9/1953 |
| FR | 1 216 016 | 4/1960 |
| GB | 455 170 | 8/1936 |
| GB | 2 206 030 | 12/1988 |
| GB | 2 223 394 | 11/1990 |
| GB | 2 256 784 | 12/1992 |
| GB | 2 340 378 | 2/2000 |
| GB | 2 368 772 | 5/2002 |
| GB | 2 377 616 | 1/2003 |
| JP | 2002-272506 | 9/2002 |
| WO | WO 95/22915 | 8/1995 |
| WO | WO 98/08405 | 3/1998 |
| WO | WO 98/39985 | 9/1998 |
| WO | WO 00/53043 | 9/2000 |
| WO | WO 01/56420 | 8/2001 |
| WO | WO 01/72161 | 10/2001 |
| WO | WO 03/005845 | 1/2003 |
| WO | WO 03/045182 | 6/2003 |
| WO | WO 03/071893 | 9/2003 |
| WO | WO 03/101236 | 12/2003 |
| WO | WO 2005/g072551 | 8/2005 |

* cited by examiner

Fig.7a
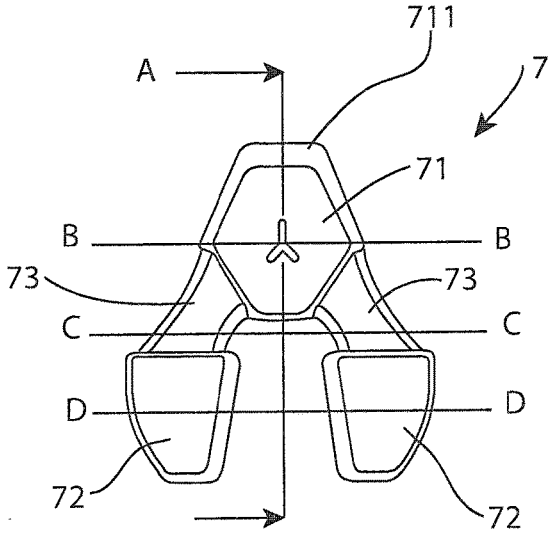
Fig.7b
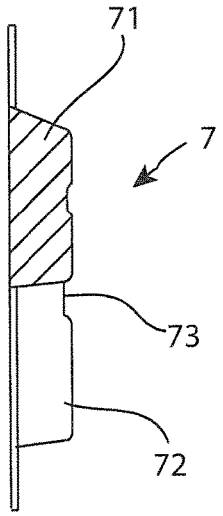
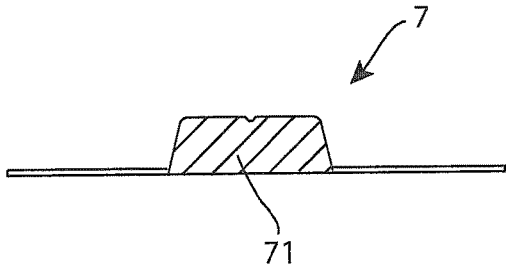
Fig. 7c
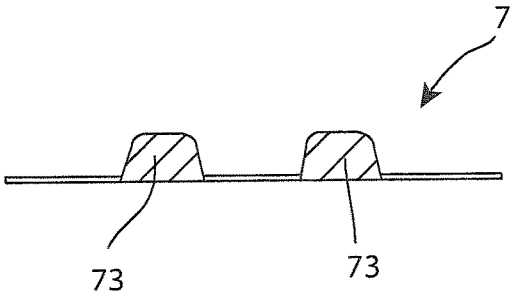
Fig. 7d
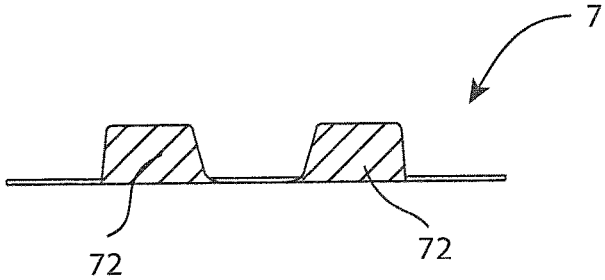
Fig. 7e

FOOTWEAR SOLE

CROSS REFERENCE TO RELATED APPLICATIONS

This application is a continuation of U.S. patent application Ser. No. 13/623,628, filed Sep. 20, 2012, which is a continuation of U.S. patent application Ser. No. 11/750,015, filed May 17, 2007, which claims priority from U.K. Application Serial Number 0609808.1, filed May 17, 2006, all of said applications incorporated herein by reference.

FIELD OF THE INVENTION

The field of this invention relates to soles for footwear, and in particular, but not exclusively, soles for use in sports and recreational footwear.

BACKGROUND

To improve traction (grip) of footwear such as walking boots, running shoes, football boots etc., the soles commonly have a plurality of studs (sometimes referred to as cleats) extending from the bottom surface of the sole. The studs are normally spaced apart from one another.

When the wearer of the sole walks or runs etc., upon ground contact, the studs are designed to penetrate or otherwise interact with the ground, so as to inhibit sliding of the footwear over the ground. As the studs contact the ground, a force is applied to the studs in a direction normal to the bottom surface of the shoe sole, counteracting the wearer's weight, and also in shear directions, i.e. in a direction substantially parallel to the bottom surface of the sole. The force applied in the shear direction may be, effectively, a 'braking force' or 'accelerating force', which inhibits or effects, respectively, further movement of the studs with respect to the ground.

Figure 1B:
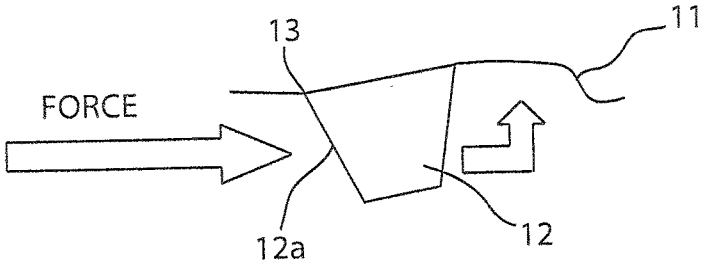
Fig. 1b (prior art)

However, with this conventional stud arrangement, the studs have a propensity to pivot about the connection point between the stud and the sole. This effect is exemplified in FIGS. 1*a* and 1*b*. FIG. 1*a* shows a conventional stud 12 fixed to a sole 11 prior to application of the 'braking force'. FIG. 1*b*, shows the position of the stud once the braking force is applied; the stud 12 has pivoted about a connection point 13 between the stud 12 and the sole 11. As can be seen, this pivoting causes deformation of the sole, which can cause discomfort to the wearer. Furthermore, the angle of the leading surface 12*a* of the stud 12, which opposes the braking force, has changed. The surface 12*a* has tilted substantially, and the effectiveness of the stud to provide traction has therefore decreased.

Conventional studs are usually frusto-conical in shape, tapering towards their distal ends. This tapering increases the studs' ability to penetrate the ground upon ground contact. In general, the smaller the studs, the better they are at ground penetration (at any given penetration force). However, the smaller the studs are, in general, the worse they are at coping with the forces applied to them upon ground contact.

Japanese Patent Application No. JP2002-272506 discloses a stud arrangement in which studs are arranged in clusters. Each cluster has three studs linked by connection elements. The purpose of this arrangement is to reduce the 'push-up feeling', i.e. the discomfort caused by forces transmitted from the studs to the sole of the wearer's foot, when the studs contact the ground, since the forces are spread across the studs of the stud cluster, and thus over a wider area.

European patent application No. EP 1234516 discloses a sole structure for a football shoe that is divided into six portions having different rigidities. Sole pressure distribution diagrams are used to determine the appropriate rigidity for each portion. Blade-shaped studs are placed on the sole structure only at areas of high pressure, and the orientation of the blade-shaped studs is based on 'active direction distribution diagrams' so as to sustain forces applied from the ground to the foot.

DEFINITIONS

In this description, the term "bottom surface" is used to describe the surface of the sole that contacts the ground in use, either directly or via the studs. The terms "heel region", "midfoot region" and "toe region" are used to describe the regions of the bottom surface of the sole, which, in use, are adjacent the heel, midfoot and toes/ball, respectively, of the sole of the wearer's foot. The "toe end" and the "heel end" of the sole should be construed accordingly. The terms "medial side" and "lateral side" are used to describe the sides of the sole, which, in use, are nearest the medial (inside) and lateral (outside) of the wearer's foot respectively. The term "forward direction" is used to describe a direction extending substantially from the heel end to the toe end of the sole and the term "backward direction" should be construed accordingly. The terms "forward of" and "backward of", used to describe relative positioning of the studs, should be construed accordingly. The term "sideways direction" of the sole is used to describe a direction substantially perpendicular to the forward and backward directions and substantially parallel to the bottom surface of the sole.

SUMMARY OF THE INVENTION

It is a general proposition of the invention to provide a sole for a shoe having stud formations of different dimensions and/or orientations at predetermined locations of the sole, and a method of manufacture thereof.

According to a first aspect of the present invention, there is provided:

a sole for a shoe having a bottom surface with a plurality of stud formations extending therefrom, wherein the stud formations are dimensioned in accordance with the distribution of forces applied to the sole during ground contact.

Preferably, the stud formations are oriented in accordance with the distribution of forces applied to the sole during ground contact.

The stud formations may be individual studs, or, preferably, stud clusters, each stud cluster comprising at least two studs connected via one or more connection elements. Preferably, the stud clusters are dimensioned in accordance with the typical distribution of forces applied to the sole during ground contact.

The stud formations may be dimensioned directly in proportion with the forces, preferably the peak and/or average forces, applied to the region of the sole at which they are located, during ground contact. Ground contact occurs when a wearer of the sole (more specifically a wearer of a shoe or boot bearing the sole) takes a step onto the ground whilst walking, jogging or running etc.

The force direction and magnitude may be determined using a force plate such as the Kistler Type 9287B. A wearer of a shoe may step on the plate during a running, walking step etc., and the direction and magnitude of the forces applied across the sole during ground contact may be measured using the plate. As an alternative, or in addition, the wearer may step on a pressure sensor pad system. The wearer may step on the pressure sensor pad barefooted, or the pressure sensor pad may be placed inside the shoe, to determine the forces that are applied to the sole of the shoe directly from the wearer's foot, or to the wearer's foot, during ground contact.

Preferably, the stud formations are dimensioned in accordance with the peak forces at their respective position of the sole during ground contact.

The force distribution over the sole may vary depending on the activity in which the sole is used. For example, if the sole is used for running, the pressure force distribution will normally be different from that of a sole used for walking or used in 'lateral sports' such as tennis or basketball. Accordingly, in the present invention, the size and/or orientation of the stud formations may be optimised depending on the intended activity for the sole.

Preferably, the stud formations located at regions of the sole which are subject to higher forces during ground contact are larger than the stud formations located at regions of the sole subject to lower forces during ground contact.

In this description, a stud cluster may be larger than another stud cluster by having one or more larger studs than the other stud cluster, and/or one or more larger connection elements. Preferably, larger studs and connection elements have a greater spatial extent over their cross-section than smaller studs and connection elements.

Normally, the larger the stud formations, the better they are of counteracting the applied force. However, normally, the larger the stud formations, the harder it is for the studs to penetrate the ground. Therefore, in the preferred embodiment of the first aspect of the present invention, by dimensioning the stud formations in accordance with the force distribution, the balance between counteracting the applied force and having good ground penetration can be optimised.

It has been found that, when the sole is used for running, for example, the forces applied to the sole are higher at a central area, e.g. towards the mid-line, of the sole than the forces applied at the periphery of the sole. Thus, the stud formations located at the central area of the sole may have larger dimension than the stud formations located at the periphery of the sole. In view of this, the stud formations located at the central area of the toe region of the sole, e.g. at a region beneath the ball of the foot ($1^{st}$ and $2^{nd}$ Metatarsal-phalangeal joint), may have larger dimension than the stud formations located at the periphery of the toe region of the sole and/or the stud formations located at the central area of the heel region of the sole may have larger dimensions than the stud formations located at the periphery of the heel region of the sole.

It has been found that, when the sole is used for walking, for example, the forces applied to the sole are more evenly distributed across the sole than when the sole is used for running. Accordingly, the stud formations may be similar in dimension at the central region and periphery of the sole.

The connection elements of the stud clusters may transfer forces between the studs. The connection elements may act, effectively, as support bars or buttresses for the studs of the stud clusters.

When a wearer is walking or running forward, upon ground contact (during a step) forces act between the sole and the ground in generally vertical direction (i.e. a direction substantially normal to the bottom surface of the sole) and in a generally shear direction (i.e. a directions generally parallel to the bottom surface of the sole). The direction of the shear force may be determined for each stud cluster at a given time during ground contact (e.g. by using the Kistler platform discussed above or by other methods discussed below). Accordingly, the stud clusters may be oriented to give the most effective braking and accelerating characteristics to the sole.

In more detail, the studs of the stud clusters may penetrate the ground and push against the ground during a step. A direction of gross shear motion may be determined for all the stud clusters. The direction of gross shear motion is the direction of the dominant shear force, which is applied to the ground by the stud cluster at a given time during ground contact, or is an average of the dominant force direction over a period of time during ground contact. The given time during ground contact may be during the initial contact phase, the stance phase or the propulsive phase of ground contact. The given time may be different for different stud clusters. For example, the direction of gross shear motion may be determined during the propulsive phase, for stud clusters at the toe region of the sole, and during the initial contact and/or stance phases, for the stud clusters at the other regions of the sole. If the direction is averaged over a period of time, the period of time may cover one or any combination of the initial contact phase, the stance phase or the propulsive phase of ground contact. The initial contact phase is the part of a step in which a (usually backward oriented) braking force is applied to the stud clusters by the ground, inhibiting further movement thereof, and the propulsive phase is the part of the step in which a (usually forwards oriented) force is applied to the stud cluster by the ground, enabling the next step to be taken. The stance phase is intermediate of the initial contact and propulsive phases.

The direction of gross shear motion of each stud cluster may not be the same. The direction may depend on the position of the stud on the sole, and the type of motion of the wearer—running, jogging, walking (uphill, downhill, on flat ground etc.), lateral sport, e.g., basketball and tennis etc. Thus, different gross shear motion directions can be predetermined for a variety of stud clusters depending on their positions on the sole, and depending on the intended purpose of the sole. For example, if the sole is intended for running, the direction of gross shear motion of all the studs clusters may be oriented substantially forward (i.e. in a direction extending from the 'heel' to the 'toe' of the shoe sole), if calculated during the initial contact and/or stance phases. Alternatively, if the direction of gross shear motion is calculated during the propulsive phase of running, it may be oriented substantially backward at the toe region of the sole. However, if the shoe sole is intended for trekking, although the directions of gross shear motion of the stud clusters nearest the toe end of the sole may be oriented substantially forward, the directions of gross shear motion of the stud clusters toward the heel end of the shoe sole may be oriented in a more sideways direction. Conversely, if the shoe is intended for tennis, the direction of gross shear motion of the stud clusters nearest the heel end may be oriented substantially forward, and the directions of gross shear motion of the stud clusters toward the toe end may be oriented in a more sideways direction.

The direction of gross shear motion of the stud may be determined using a force platform, such as the "OR6-6" force platform made by Advanced Mechanical Technology, Inc., which can measure the scale (and direction) of the forces on the sole in relation to time using a plurality of strain gauges.

According to the present invention, the orientation and arrangement of the studs in each cluster may be arranged so as to optimise the studs' behaviour when subject to forces (pressures) upon ground contact.

According to a second aspect of the present invention, there is provided a shoe sole having a bottom surface with a plurality of stud clusters extending therefrom, each stud cluster comprising at least two studs connected via one or more connection elements, wherein each stud cluster is oriented in accordance with a predetermined direction of gross shear motion of the stud cluster.

Preferably, the stud clusters comprise a primary stud and one or more secondary studs.

The primary stud may be configured to bear the most force of all the studs of the stud cluster during ground contact. Preferably, therefore, the primary stud is larger than the secondary stud(s). The primary stud may be considered as the dominant stud. There may be any number of dominant and primary studs.

Preferably, the secondary studs trail the primary stud in the predetermined direction of gross shear motion of the stud cluster.

In its most simple arrangement, the stud cluster comprises only two studs: a primary stud and a secondary stud, with a single connection element joining the two studs together. With this arrangement, if the secondary stud trails the primary stud in the predetermined direction of gross shear motion of the stud cluster, the primary stud will normally encounter the largest shear force first and, upon contacting with ground, the primary stud will be pressed toward the secondary stud. Without the connection element and secondary stud, the primary stud would have a propensity to rotate upon ground contact, pressing the sole up into the wearer's foot (as described above with reference to FIG. 1). However, the connection element and the secondary stud act, essentially, as a buttress to the primary stud, reducing or eliminating any pivoting of the primary stud. This improves comfort for the wearer, by reducing the penetration of the studs through the sole of the shoe and reducing the occurrence of areas of high pressure at the shoe-foot interface, and it improves the grip of the studs.

The primary stud and the secondary stud may both lie on a line parallel to the predetermined direction of gross shear motion of the stud cluster. However, in this aspect of the invention, the secondary stud is considered to trail the primary stud if it lies to the rear of a line perpendicular to the axis parallel to the direction of gross shear motion of the stud cluster.

The stud clusters may take a more complicated arrangement. For example, at least one stud cluster of the shoe sole may be V-shaped, wherein the primary stud is situated at the apex of the V-shape and is connected by two connection elements to two secondary studs located, respectively, at the two ends of the V-shape.

With this arrangement, the primary stud has two buttresses, as opposed to the single buttress described above with respect to the simpler stud cluster. Accordingly, increased support to the primary stud is provided. This arrangement also provides support to the primary stud from forces acting at an angle to the direction of gross shear motion of the stud cluster.

Preferably, the secondary studs lie either side of an axis parallel to the predetermined direction of gross shear motion of the stud cluster, which extends through the primary stud, and preferably the secondary studs are equidistant from this axis.

The V-shaped stud cluster may comprise, additionally, a tertiary stud. The tertiary stud is connected to the primary stud via a further connection element and may lead the primary stud in the predetermined direction of gross shear motion of the stud cluster. Since it leads the primary stud in this direction, the tertiary stud will normally contact the ground before the primary stud. Preferably, the tertiary stud is smaller than the primary stud, making it more suitable for ground penetration. Thus, the tertiary stud may be considered as an initial ground penetration stud. The tertiary stud may be the same size and/or shape as the secondary studs.

A number of other arrangements of studs and connection elements in each stud cluster are conceived. For example, at least one stud cluster of the sole may be quadrilaterally-shaped, having four studs connected in a loop by four connection elements, one of the studs being a primary stud, and the other studs being secondary and/or tertiary studs. The number of studs within each stud cluster is not intended to be limited, nor is the ratio of primary to secondary studs.

Stud clusters may be linked. For example, a plurality of V-shaped stud clusters may be linked in a general zigzag arrangement. The stud clusters may share secondary studs to facilitate this arrangement.

As mentioned above, if the shoe sole is intended for running for example, the predetermined directions of gross shear motion of the stud clusters are usually oriented substantially in the forward direction. Thus, in this scenario, if the secondary stud trails the primary stud in the predetermined direction of gross shear motion, the primary stud in each stud cluster will be forward of the secondary stud(s). However, to optimise performance during the propulsive phase, where the directions of gross shear motion of the stud clusters at the toe region of the shoe are usually oriented substantially in the backward direction, the primary stud in each stud cluster at the toe region may be behind the secondary stud(s). This may also apply to the shoes intended for other athletic purposes discussed herein.

As also mentioned above, if the shoe sole is intended for trekking, although the predetermined directions of gross shear motion of the stud clusters toward the toe end of the shoe sole are oriented substantially forward, the predetermined directions of gross shear motion of the stud clusters toward the heel end of the shoe sole are oriented in a more lateral direction. Thus, in this scenario, if the secondary stud trails the primary stud in the predetermined direction of gross shear motion, the primary stud in each stud cluster will be forward of the secondary stud(s) at the toe region of the sole, but will be less so in the stud clusters at the heel region of the sole. In fact, the secondary studs at the heel region may be forward of the primary studs of the respective stud cluster (i.e., closer to the toe end of the sole than the primary stud), even though they trail the primary stud in the predetermined direction of gross shear motion.

According to a third aspect of the present invention, there is provided a shoe sole having a bottom surface with a plurality of stud clusters extending therefrom, each stud cluster comprising a primary stud connected via one or more connection elements to one or more secondary studs, wherein the primary stud is larger than the secondary studs.

The studs according to the aspects of the present invention may take a variety of cross-sectional shapes (the cross-section of the studs lying on a plane generally parallel to the bottom surface of the sole). For example, when more gradual braking is needed at high movement velocities, the studs may have an elliptical cross-section shape, with a steeply-curved leading end (the end leading in the direction of gross shear motion, which is normally the first end of the stud to resist the ground shear forces in a braking action during ground contact), or be triangular or diamond shaped with a wedge-like leading end. As another example, when greater breaking performance is required at lower or higher movement velocities (and when ground penetration may not be an issue), the stud may have a flat leading end. It may therefore take the form of a square or rectangle for example. Where the stud is intended for 'multipurpose' use, it may have a cross-sectional shape which is essentially a compromise between those of the aforementioned examples, such as a circular cross-sectional shape, with a reasonably shallow-curved leading end.

DETAILED DESCRIPTION

Figure 2A:
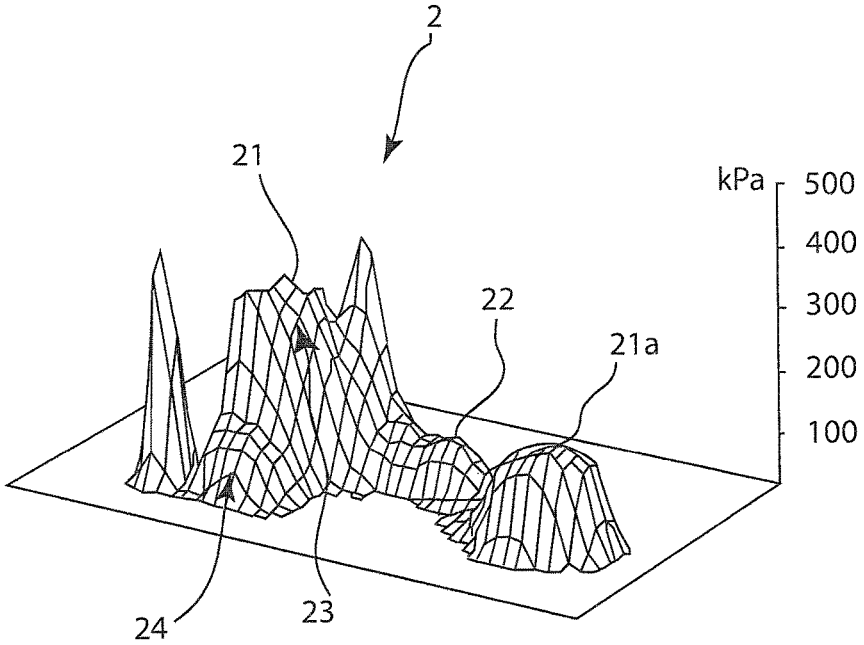
Figure 2B:
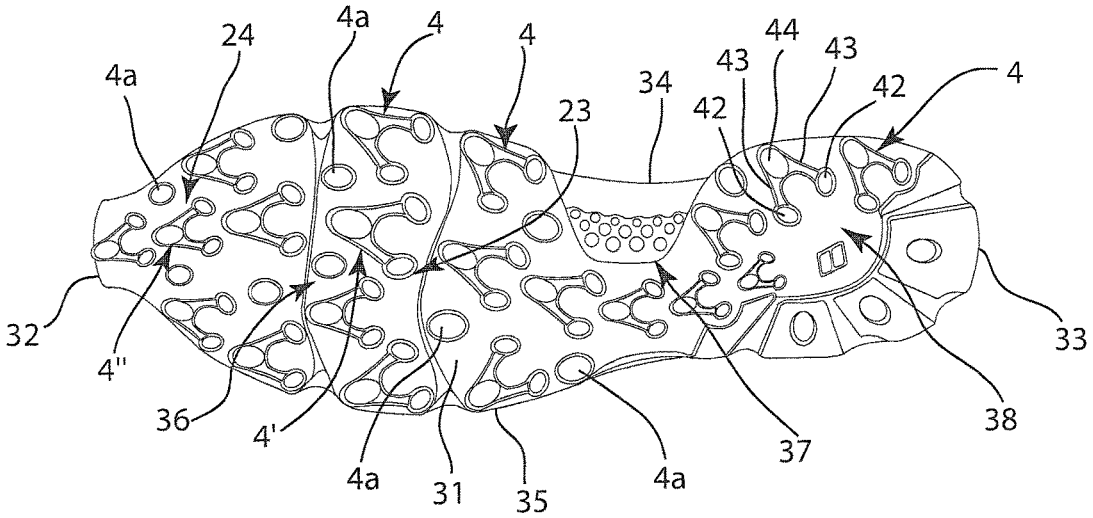
Figure 3A:
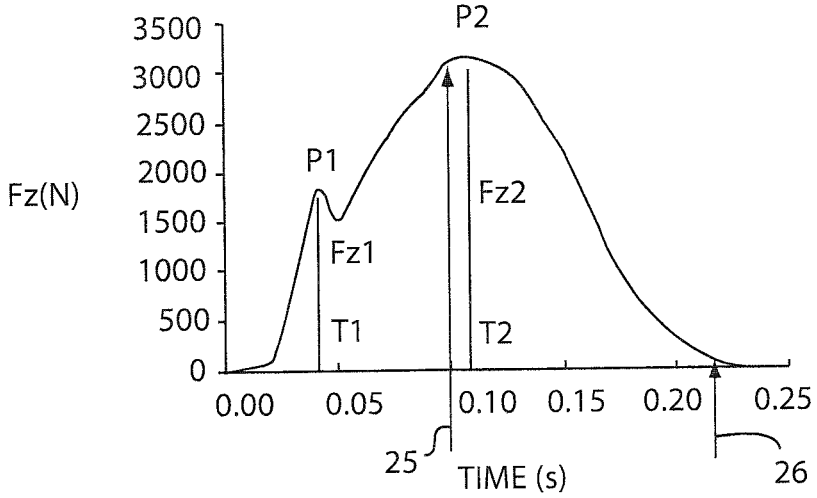
Figure 3B:
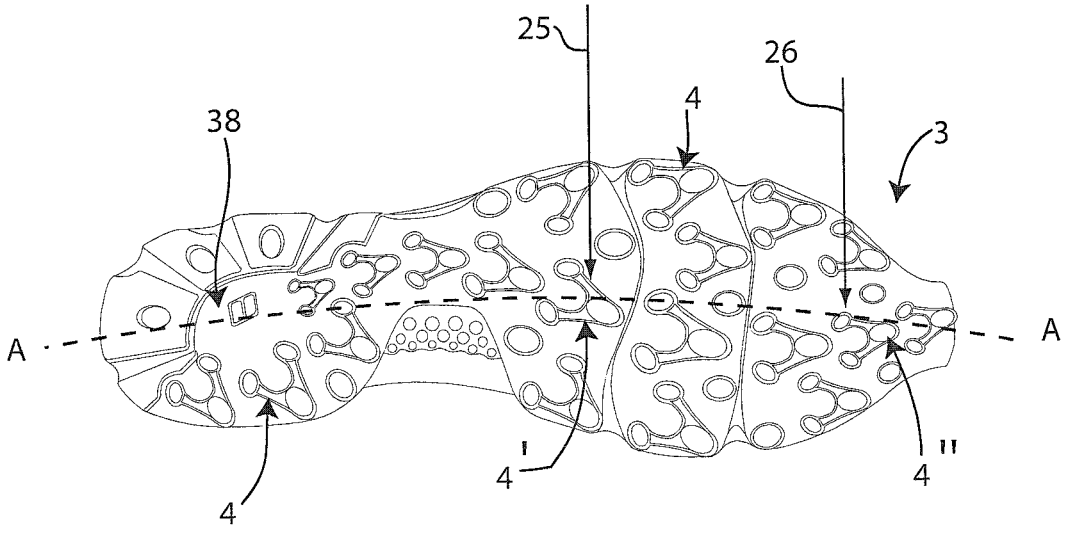

Embodiments of the present invention are now described with reference to the accompanying drawings, in which:

FIGS. 1*a* and 1*b* show the behaviour of a discrete stud subject to a braking force;

FIG. 2*a* shows a graph of the peak pressure distribution across a sole during ground contact in a step;

FIG. 2*b* shows a bottom view of a sole according to a first embodiment of the present invention;

FIG. 3*a* shows a graph of the forces applied to the sole during ground contact in a running step;

FIG. 3*b* shows another bottom view of the sole of FIG. 2*b;*

Figure 4A:
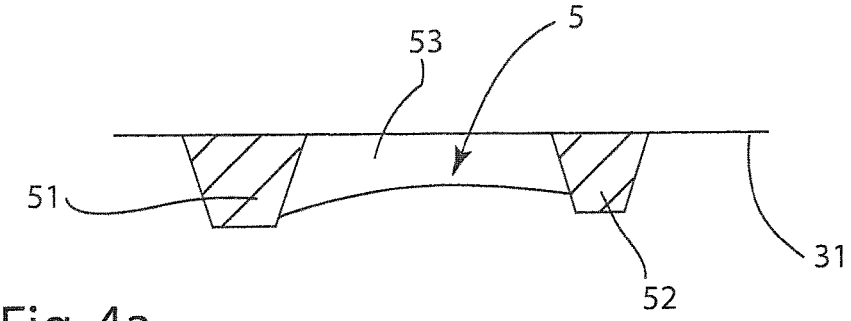
Figure 4B:
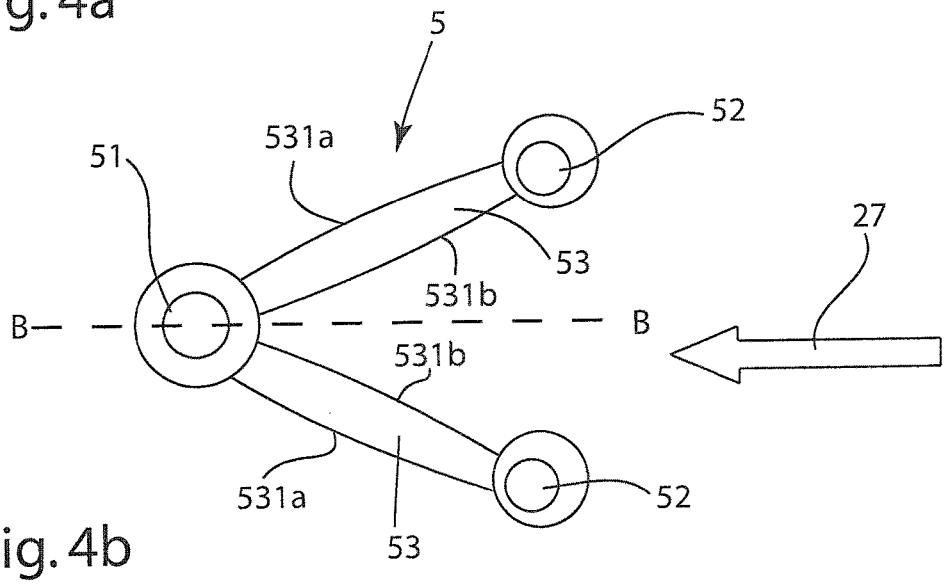

FIG. 4*a* shows a side view of an alternative stud cluster according to the present invention;

FIG. 4*b* shows a plan view of the stud cluster of FIG. 4*a;*

Figure 5:
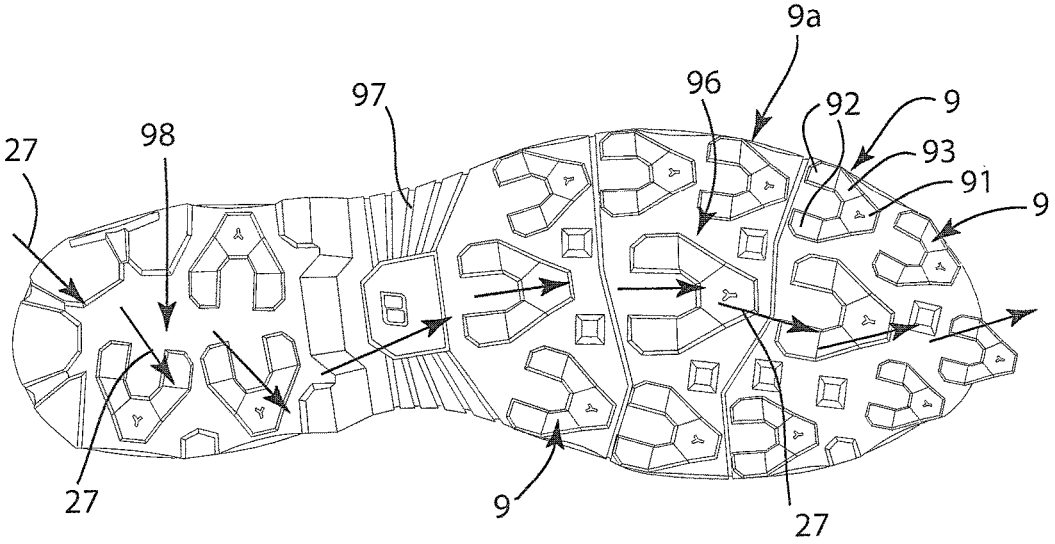
Figure 6A:
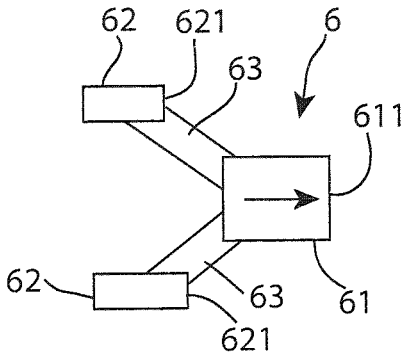
Figure 6B:
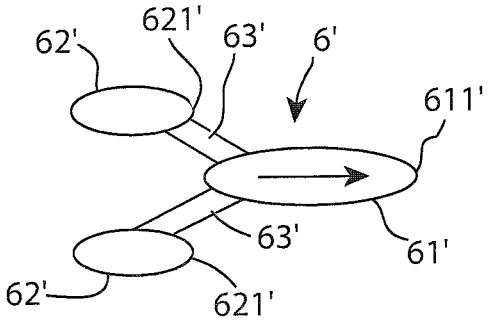
Figure 6C:
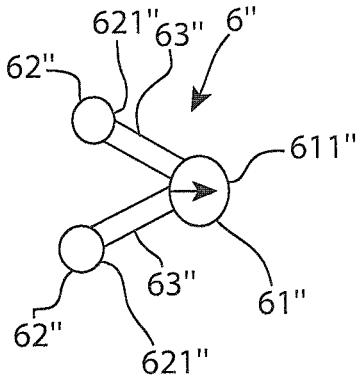
Figure 8A:
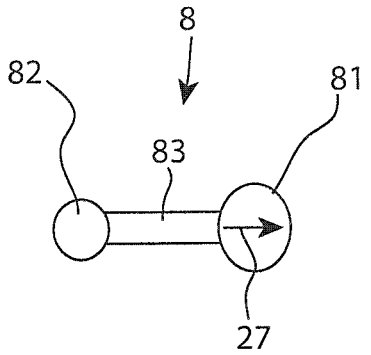
Figure 8B:
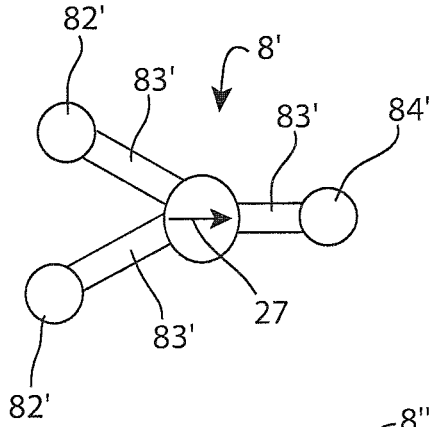
Figure 8C:
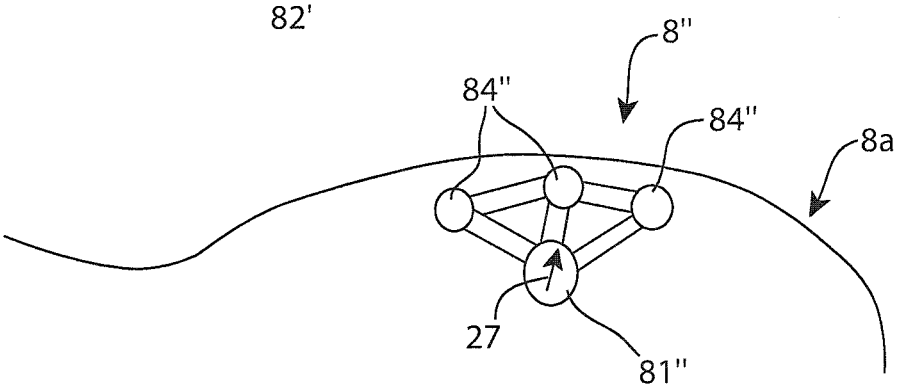
Figure 9A:
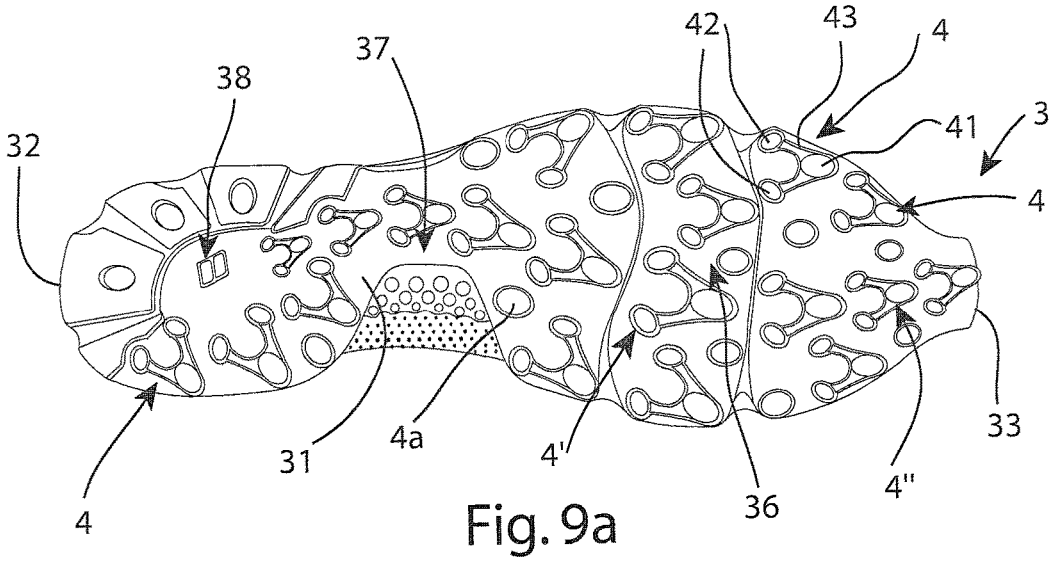
Figure 9B:
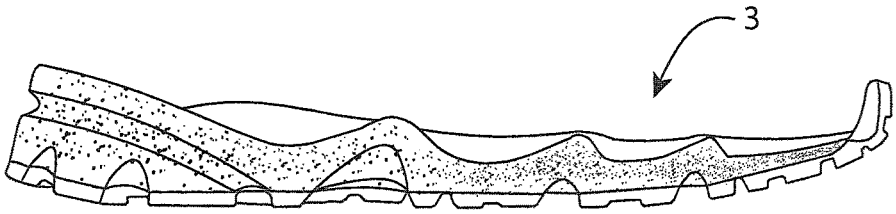
Figure 9C:
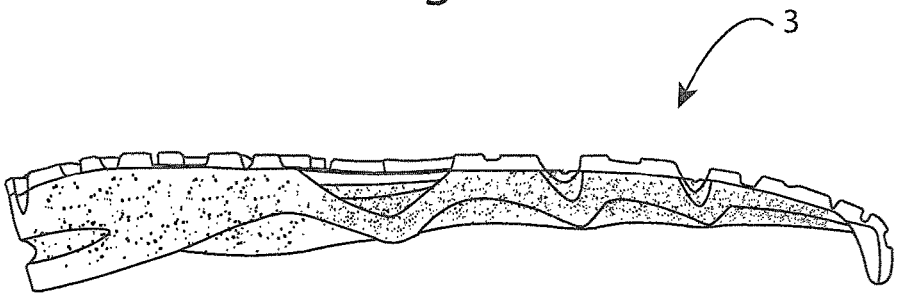
Figure 10A:
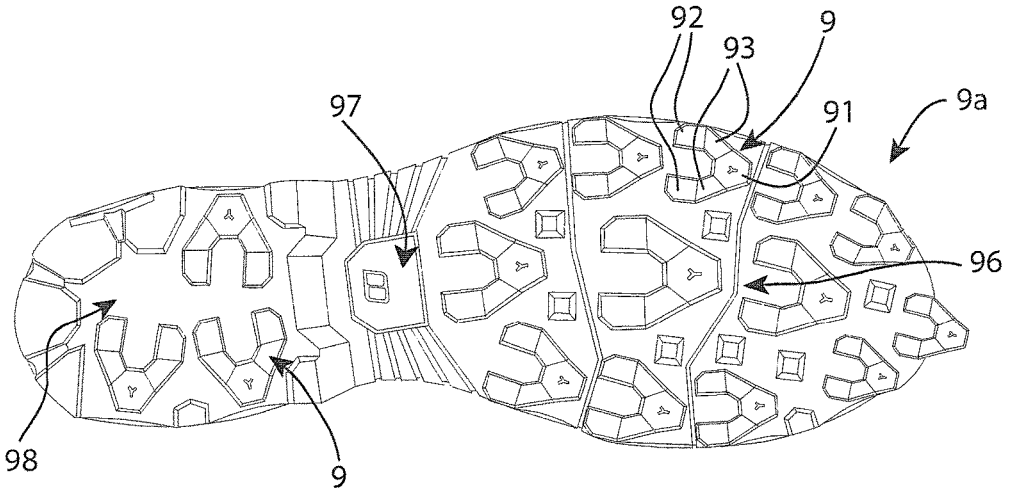
Figure 10B:
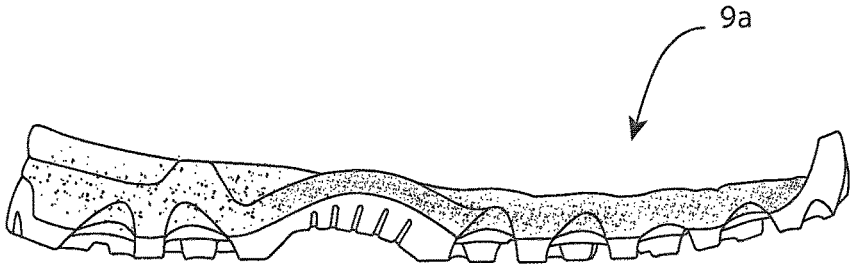
Figure 10C:
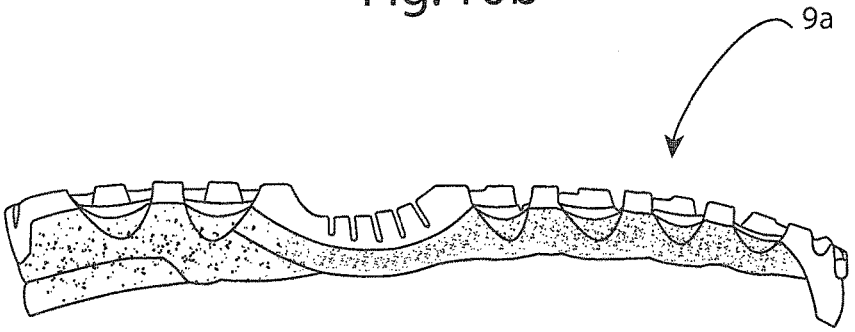

FIG. 5 shows the direction of gross shear motion across a sole according to a second embodiment of the present invention;

FIGS. 6*a*, 6*b* and 6*c* show plan views of alternative stud clusters according to the present invention;

FIGS. 7*a* to 7*e* show various views of an alternative stud cluster according to the present invention; and FIGS. 8*a*, 8*b* and 8*c* show plan views of alternative stud clusters according to the present invention;

FIGS. 9*a*, 9*b* and 9*c*, show plan, lateral side and medial side views respectively of the sole according to the first embodiment of the invention; and FIGS. 10*a*, 10*b* and 10*c*, show plan, lateral side and medial side views respectively of the sole according to the second embodiment of the invention.

Figure 11:
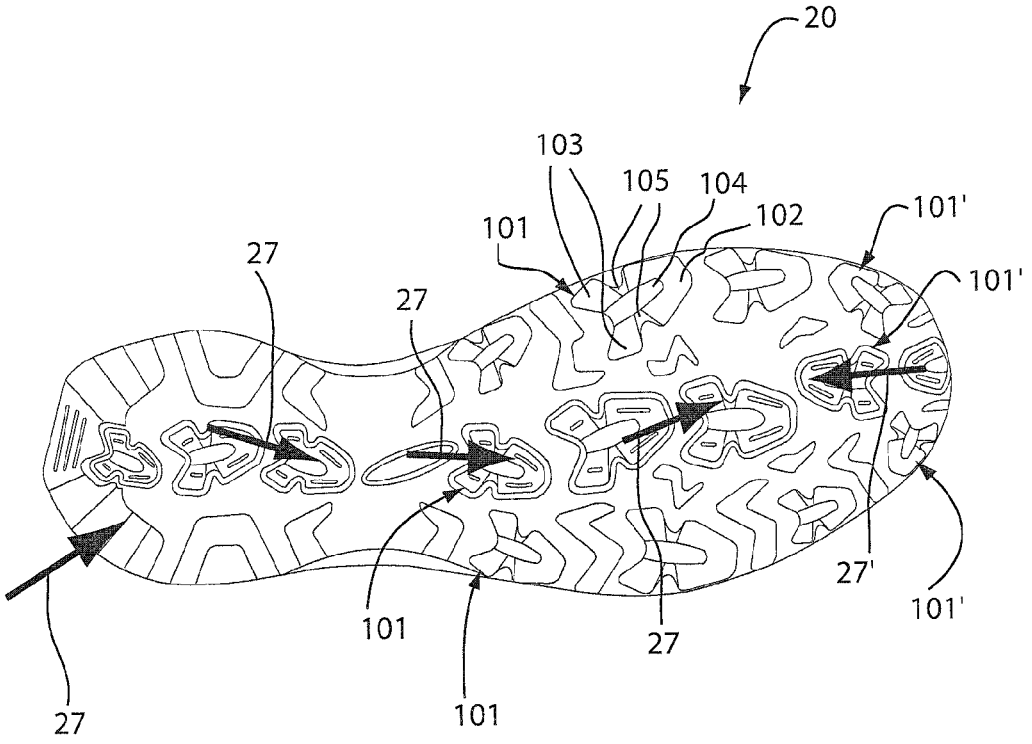

FIG. 11 shows a plan view of a sole according to the third embodiment of the invention.

FIG. 2*a* shows a pressure distribution graph 2 (or 'map'), i.e. a 3D plot of the force per unit area, applied to the sole of a foot in a shoe during the ground contact phase of a running step.

The graph's peaks or high points, e.g. as indicated by reference numeral 21, and low points, e.g. as indicated by reference numeral 22, indicate areas of the sole that are subject to, respectively, higher and lower peak pressures/forces during the ground contact phase of a step.

FIG. 2*b* shows a sole 3 for a shoe according to a first embodiment of the present invention. An enlarged version of this sole 3 is shown in FIG. 9*a*, along with lateral and medial side views of the sole 3 in FIGS. 9*b* and 9*c* respectively. The sole 3 has a bottom surface 31, with a toe end 32 and a heel end 33, a medial side 34 and a lateral side 35. The sole is intended to be used in a running shoe. The bottom surface of the sole has three main regions: a toe region 36; a midfoot region 37 and a heel region 38.

The bottom surface 31 includes a plurality a stud formations extending therefrom. In this embodiment, the stud formations are V-shaped stud clusters 4 each comprising a primary stud 41 and two secondary studs 42, connected via connection elements 43. Single, discrete studs 4*a* are also distributed across the sole 3.

As can be seen in FIG. 2*b*, the stud clusters are not all the same size. The stud clusters 4 are dimensioned in proportion to the peak pressure/forces applied to the part of the sole at which they are located, as determined from the pressure distribution graph 2 of FIG. 2*a*.

The arrows 23 point out a part of the pressure distribution graph 2 that is associated with a particular stud cluster 4'. The stud cluster 4' is located at a middle (central) area of the toe region 36 of the bottom surface 31. This part of the pressure distribution graph is at a high point 21 of the graph, and, accordingly, the associated stud cluster 4' is the largest stud cluster 4 of the sole 3.

The arrows 24 point out a part of the pressure distribution graph 2 associated with a different stud cluster 4". The stud cluster 4" is located at the periphery of the toe region 36 of the bottom surface 31. As can be seen, this part of the pressure distribution map is a low point of the map, and, accordingly, the associated stud cluster 4" is one of the smaller stud clusters 4 of the sole 3.

FIG. 3*a* shows a graph of the forces applied to the sole 3 over the course of ground contact during a running step along a central longitudinal axis of the sole 3, generally indicated by dotted line A-A in FIG. 3*b*. The graph has two peaks, 'P1' and 'P2'. Peak 'P1' occurs during the initial contact phase between the heel region 38 of the sole 3 and the ground, between 50 and 100 milliseconds after initial ground contact. Peak 'P2' occurs during the propulsive phase between the toe region 36 and the ground, after approximately 80% of the ground contact period. As can be seen, P2 is higher than P1 (at higher speeds, this pattern would normally be reversed). This disparity correlates with the peak pressures shown in the pressure distribution graph 2 (FIG. 2*a*), where the peak pressure 21 at the toe region in the graph 2 is higher than the peak pressure 21*a* at the heel region of the graph 2. In the graph of FIG. 3*a*, the force approaches zero at approximately 0.22 seconds, when the sole no longer contacts the ground.

Arrows 25 point out a part of the graph associated with the stud cluster 4'. This part of the graph is approximate peak P2, which is the highest peak of the graph. This is in conformity with stud cluster 4' being the largest stud cluster 4 as described above.

Arrows 26 point out the part of the graph associated with the stud cluster 4", which is located at the toe end 32 of the sole 3. The force is almost zero at this point. This is in conformity with stud cluster 4" being one of the smallest stud clusters 4 as described above. In the first embodiment, the primary stud 41 and the secondary studs 42 of each V-shaped stud cluster 4 has a generally elliptical cross-section (in a plane substantially parallel to the bottom surface 31 of the sole 3). The connection elements 43 are elongated bars with flat bottom surfaces 431 and parallel sides 432. The primary stud 41 is located at the apex of the V-shape, and the secondary studs 42 are located at the two ends of the V-shape.

FIGS. 4*a* and 4*b* show an alternative stud cluster 5 to the stud cluster shown in FIGS. 2*b* and 3*b*. The stud cluster 5 is V-shaped, like the stud cluster 4 of the first embodiment, but it differs from the stud cluster 4 in that it comprises a frustro-conical primary stud 51 and frustro-conical secondary studs 52. The connection elements 53 are bowed. Looking at FIG. 4*a*, the connection elements 53 rise up toward the primary and second studs 51, 52 (they extend from the bottom surface 31 of the sole 3 to a greater degree as they approach the primary and secondary studs 51, 52). However, at no point do the connection elements extend beyond the primary and secondary studs 51, 52. This arrangement permits good contact to be made between the connection elements 53 and the primary and secondary studs 51, 52, for efficient transferral of force therebetween, but ensures that the primary contact between the stud clusters 5 and the ground is via the primary and secondary studs 51, 52, rather than the connection elements.

Arrow 27 indicates a possible direction of gross shear motion for the stud cluster 5 in FIG. 4*b*. In general, the direction of gross shear motion 27 corresponds to the direction of the dominant force, running parallel to the bottom surface of the sole, which is applied to the ground by the stud cluster 5 at a given time during ground contact, or is an average of the dominant force direction over a period of time during ground contact. For this particular stud cluster 5, the direction of gross shear motion indicated by arrow 27 has been determined during the initial contact phase of ground contact of a walking or running step, where the force applied to the ground by the stud cluster generates a strong reactionary braking force which is applied to the stud cluster by the ground. In this instance, the braking force is directed in an opposite direction to the direction of gross shear motion. To deal effectively with the braking force, the stud cluster 5 is oriented so that the secondary studs 52 trail the primary stud 51 in the direction of gross shear motion of the stud cluster, and the secondary studs lie either side of an axis (line B-B), parallel to the direction of gross shear motion of the stud cluster, which extends through the primary stud 51. The secondary studs 52 are equidistant from this axis.

Accordingly, when the braking force is applied to the primary stud 51 during ground contact, this force is directed efficiently through the connection elements 53, to the secondary studs 52. Effectively, the connection elements 53 and secondary studs 52 act as buttresses to the primary stud 51.

Due to the orientation of the connection elements 53, a fraction of the braking force is applied directly to the outer sides 531*a* of the connection elements 53. Therefore, the outer sides 531 a of the connection elements 53 offer additional braking surfaces for the stud cluster 5. This arrangement permits forces to be distributed more evenly over the whole of the stud cluster 5, reducing the burden on any one particular part of the stud cluster 5.

During the propulsive phase of ground contact of a running or walking step, the propulsive force is usually applied to the stud cluster 5 by the ground in a direction opposite to the braking force. Accordingly, the inner sides 531*b* of the connection elements 53 offer additional propulsive surfaces for the stud cluster 5. Once again, this arrangement permits forces to be distributed more evenly over the whole of the stud cluster 5, reducing the burden on any one particular part of the stud cluster 5.

Reference should now be made to FIG. 5, which shows a sole 9*a*, according to a second embodiment of the invention, with the direction of gross shear motion across the sole 9*a*, when the sole 9*a* is used for walking or trekking, indicated by the arrows 27. An enlarged version of this sole 9*a* is shown in FIG. 10*a*, along with lateral and medial side views of the sole 9*a* in FIGS. 10*b* and 10*c* respectively. The sole 9*a* has a plurality of V-shaped stud clusters 9 with primary studs 91 connected via connection elements 93 to secondary studs 92, similar to stud clusters 4 as already described above. The primary studs 91 have generally hexagonal cross-sections (in a plane substantially parallel to the bottom surface 31 of the sole 3). The secondary studs 92 have generally rectangular cross-sections, with a cut-off corner. This shape of studs 91, 92 offers good braking performance. The stud clusters 9 are dimensioned according to pressure distribution, in a similar way to the stud clusters 4 described above in relation to FIGS. 2*b* and 3*b*. However, since the sole 9*a* is intended for trekking or walking, and forces are distributed more evenly across a sole during walking the running, the range of sizes of the stud clusters 9 is less varied than the stud clusters 4.

As can be seen, within each stud cluster 9, the secondary studs 92 trail the respective primary stud 91 in the direction of gross shear motion at that part of the sole 9*a*. Since the direction of the gross shear motion changes across the sole 9*a*, the orientation of the stud clusters 9 also changes across the sole, permitting the stud clusters 9 to deal with the forces applied to them effectively (as described above with respect to stud cluster 5 of FIGS. 4*a* and 4*b*). The stud clusters 4 in the first embodiment of the invention have also been oriented in view of their respective directions of gross shear motion under the same principles.

The direction of gross shear motion at the heel region 98 of the sole 9*a* is generally sideways (lateral to medial in direction), whereas the direction at the toe region 96 is more forward (posterior to anterior in direction). Accordingly, the primary stud 91 in each stud cluster 9 is forward of the secondary studs 92 at the toe region of the sole 96, but is less so in the stud clusters 9 at the heel region 98 of the sole 9*a*.

FIGS. 6*a* to 6*c* show alternative configurations of the stud clusters according to the present invention.

The stud clusters 6, 6' and 6" of FIGS. 6*a* to 6*c* are all V-shaped, with primary studs 61, 61', 61" connected to secondary studs 62, 62', 62" via connection elements 63, 63', 63". However, the cross-sectional shape of the primary studs 61, 61', 61"and secondary studs 62, 62', 62" are different.

In FIG. 6*a*, the primary studs 61 and secondary studs 62 of the stud cluster 6 have square cross-sections. The studs 61, 62 have a generally flat leading ends 611, 621. Accordingly, the studs offer good resistance to the ground, and therefore offer greater braking potential.

In FIG. 6*b*, the primary studs 61' and secondary studs 62' of the stud cluster 6' have elliptical cross-sections with steeply curved (almost pointed) leading ends 611', 621'. Accordingly, the studs offer less resistance to the ground than the studs of FIG. 6*a* but are better at penetrating the ground. Such stud clusters 6' are considered appropriate where a degree of 'give' between the studs and the ground is desirable, e.g. to prevent injury to the wearer.

In FIG. 6*c*, the primary studs 61" and secondary studs 62" of the stud cluster 6" have circular cross-sections, a compromise between the rectangular and elliptical cross-sections. Accordingly, the stud cluster 6" is considered more of a 'multipurpose' stud cluster.

In FIG. 7*a*, another 'multipurpose' stud cluster 7 is shown. This stud cluster 7 is V-shaped, with a primary stud 71 connected via connection elements 73 to secondary studs 72. This stud cluster 7 is similar to the stud cluster 4 of FIGS. 2*b* and 3*b*, but is less angular in nature—the primary stud 71 it has a more curved leading end 711. Sectional profiles of the stud cluster along lines A-A, B-B, C-C and D-D are shown in FIGS. 7*b*, 7*c*, 7*d* and 7*e* respectively.

FIGS. 8*a* to 8*c* show further alternative configurations of the stud clusters according to the present invention.

In FIG. 8*m*. the stud cluster 8 comprises a primary stud 81 connected via a connection element 83 to only one secondary stud 82. The direction of gross shear motion of the stud is indicated by the arrow 27. Since the secondary stud 82 trails the primary stud 81 in the direction of gross shear motion of the stud cluster 8, forces can be transferred efficiently from the primary stud 81 to the secondary stud 82, in a similar way to the V-shaped stud clusters. However, since only one secondary stud 82 (and connection element 83) is used, this stud cluster is cheaper and easier to manufacture. The stud cluster 8 may be employed where less support to the primary stud 81 is necessary.

In FIG. 8*b*, the stud cluster 8' has a primary stud 81' and secondary studs 82' arranged in a V-shape. However, unlike V-shaped stud clusters discussed above, the stud cluster 8' comprises, additionally, a tertiary stud 84', connected via a connection element 83' to the primary stud 81'. The tertiary stud 84' is similar in size and shape to the secondary studs 82', but it leads the primary stud 81' in the direction of gross shear motion of the stud cluster 7', indicated by arrow 27. The tertiary stud 84' is intended to contact the ground before the primary stud 81' during the ground contact of a step. The tertiary stud 84' is smaller than the primary stud 81', making it more suitable for ground penetration than the primary stud 81'. Thus, the tertiary stud 84' may be considered as an initial ground penetration stud, improving the penetration performance of the stud cluster 8'.

In FIG. 8*c*, the stud cluster 8" has a primary stud 81" and three tertiary studs 84", but no secondary studs. This stud cluster configuration offers excellent lateral cutting action braking performance. Furthermore, since the tertiary studs 84" are connected to the primary stud, and to each other, via connection elements 83", the tertiary studs 84" offer significant support to the primary stud 81", primarily by the transmission of forces in a tensile manner. The stud cluster 8" is shown located toward the medial side of the toe region of a sole 8*a*.

FIG. 11 shows a sole 10 according to a third embodiment of the present invention, with the direction of gross shear motion across the sole 10, when the sole 10 is used for running, indicated by the arrows 27, 27'. The sole 10 has a plurality of V-shaped stud clusters 101, 101' with primary studs 102 connected via connection elements 105 to secondary studs 103. A recess 104 is provided in the middle of the stud clusters 101. The stud clusters 101, 101' are dimensioned according to forces applied to the sole, in a similar way to e.g. the stud clusters 4 described above in relation to the first embodiment. However, unlike the running shoe of the first embodiment, sole 10 is optimised to counteract shear forces applied to the stud clusters 101, 101' during the propulsive phase of ground contact, when the stud clusters 101' at the toe region of the sole will be subject to peak forces.

During the propulsive phase, the direction of gross motion 27' of the stud clusters 101' at the toe region is in a backward direction. As a result, in the stud clusters 101' are arranged such that the secondary studs 103 are forward of the respective primary stud 102, and thus the secondary studs 103 trail the respective primary stud 102 in the direction of gross shear motion 27' at the toe region of the sole 10. The studs in the other regions of the sole 10 are arranged similar to the arrangement in the first embodiment, i.e. with the secondary studs 103 backward of the respective primary stud 102.

The invention claimed is:

1. A shoe sole having a bottom surface with a plurality of stud clusters extending therefrom, each stud cluster comprising at least, a primary stud connected to a secondary stud via a connection element, wherein the primary stud is larger than the secondary stud and has a height from the bottom surface that is equal to or greater than the height of the secondary stud from the bottom surface, and the connection element has a height from the bottom surface that is less than the height of the primary and secondary studs from the bottom surface wherein each stud cluster is oriented such that the secondary stud trails the primary stud in a predetermined direction of gross shear motion of the stud cluster, and wherein the stud clusters are V-shaped, the primary stud being located at the apex of the V-shape and being connected by two connection elements to two secondary studs located, respectively, at the two ends of the V-Shape.

2. The shoe sole of claim 1, wherein the secondary studs lie either side of an axis parallel to the predetermined direction of gross shear motion of the stud cluster, which extends through the primary stud.

3. The shoe sole of claim 1, wherein the stud clusters comprise a tertiary stud connected to the primary stud via a further connection element and which leads the primary stud in the predetermined direction of gross shear motion of the stud cluster.

4. The shoe sole of claim 1, wherein, in each stud cluster, the primary stud is positioned substantially forward of the secondary studs on the bottom surface of the shoe sole.

5. The shoe sole of claim 1, wherein, in each stud duster at the toe end of the sole, the primary stud is substantially forward of the secondary studs, and, in each stud cluster at the heel region of the sole, the primary stud is positioned substantially sideways of the secondary studs.

6. The shoe sole of claim 1, wherein, in each stud duster at the toe end of the sole, the primary stud is substantially backward of the secondary studs and in each stud cluster at the heel end of the sole, the primary stud is substantially forward of the secondary studs.

7. The shoe sole according to claim 1, wherein the studs have a cross-sectional shape which is elliptical, circular, square, rectangular, triangular, or diamond-shaped.

8. The shoe sole according to claim 1, wherein the stud clusters are dimensioned in accordance with the distribution of forces applied to the sole during ground contact.

9. The shoe sole according to claim 8, wherein the stud clusters are dimensioned in proportion with the peak or average forces applied to the region of the sole at which they are located during ground contact.

10. A shoe sole having a bottom surface with a plurality of stud clusters extending therefrom, each stud cluster comprising a primary stud connected to a secondary stud via a connection element that extends up the side of the primary stud to support the primary stud against pivoting, wherein the primary stud is larger than the secondary stud and has a height from the bottom surface that is equal to or greater than the height of the secondary stud from the bottom surface, and the connection element has a height from the bottom surface that is less than the height of the primary and secondary studs from the bottom surface, wherein each stud cluster is oriented such that the secondary stud trails the primary stud in accordance with a predetermined direction of gross shear motion of the stud cluster, and wherein the stud clusters are V-shaped, the primary stud being located at the apex of the V-shape and being connected by two connection elements to two secondary studs located, respectively, at the two ends of the V-Shape.

11. A shoe sole having a bottom surface with a plurality of stud clusters extending therefrom, each cluster comprising at least a primary stud connected to two secondary studs via connection elements, wherein the primary stud is larger than the secondary studs and has a height from the bottom surface that is equal to or greater than the height of the secondary studs from the bottom surface, the connection elements having height from the bottom surface that is less than the height of the primary and secondary studs from the bottom surface, and wherein each stud cluster is oriented such that the secondary studs trail the primary stud in a predetermined direction of gross shear motion of the stud cluster.

* * * * *